US008141490B2

(12) United States Patent
DeVries et al.

(10) Patent No.: US 8,141,490 B2
(45) Date of Patent: Mar. 27, 2012

(54) DUAL FAULT SAFE AND ARM DEVICE, ADAPTIVE STRUCTURES THEREWITH AND SAFETY AND RELIABILITY FEATURES THEREFOR

(75) Inventors: Derek R. DeVries, Farr West, UT (US); Brent D. Madsen, Providence, UT (US); Scott R. Jamison, River Heights, UT (US)

(73) Assignee: Alliant Techsystems Inc., Minneapolis, MN (US)

( * ) Notice: Subject to any disclaimer, the term of this patent is extended or adjusted under 35 U.S.C. 154(b) by 0 days.

(21) Appl. No.: 12/842,767

(22) Filed: Jul. 23, 2010

(65) Prior Publication Data

US 2011/0005421 A1 Jan. 13, 2011

Related U.S. Application Data

(62) Division of application No. 11/933,883, filed on Nov. 1, 2007, now Pat. No. 7,784,404.

(51) Int. Cl.
*F42C 15/00* (2006.01)

(52) U.S. Cl. ..... 102/221

(58) Field of Classification Search ..... 102/221, 102/254, 226, 222, 228, 229, 256, 258, 251
See application file for complete search history.

(56) References Cited

U.S. PATENT DOCUMENTS 2,449,170 A * 9/1948 Maclean et al. ..... 102/226
2,630,068 A 3/1953 Clarke
2,779,287 A * 1/1957 Andrews et al. ..... 102/226
2,831,430 A 4/1958 Robertson
2,994,272 A * 8/1961 Saunderson ..... 102/254
3,151,447 A * 10/1964 Bornstein ..... 60/39.47
3,306,207 A * 2/1967 Becker et al. ..... 102/254
3,423,931 A 1/1969 Schwarz et al.
3,500,747 A 3/1970 Parker
3,529,418 A 9/1970 Puckett et al.
3,785,150 A 1/1974 Katcher
3,930,449 A 1/1976 Buchele
3,973,499 A 8/1976 Anderson
3,974,772 A 8/1976 Pelham et al.

(Continued)

OTHER PUBLICATIONS

Dept. of Defense Handbook, "Criteria for Explosive Systems and Devices Used on Space Vehicles," MIL-HDBK-83578 (USAF), Jan. 1, 1999 (superseding DoD-E-83578 of May 31, 1996).

(Continued)

*Primary Examiner* — Bret Hayes
*Assistant Examiner* — Reginald Tillman, Jr.
(74) *Attorney, Agent, or Firm* — TraskBritt

(57) ABSTRACT

A safe and arm device includes a booster base assembly having a booster base housing and a barrier. The booster base housing includes a shaft port extending substantially in line with a longitudinal axis, at least three initiator ports disposed about the axis, and a matching number of explosive transfer paths in respective communication with the at least three initiator ports. The barrier includes a matching number of fire-train transfer ports and a drive shaft. The drive shaft of the barrier is coupled within the shaft port of the booster base housing allowing the barrier to be selectively rotationally positioned about the axis into at least one of a safe position and an arm and fire position, allowing the fire-train transfer ports to be substantially aligned with the explosive transfer paths when the barrier is positioned in the arm and fire position. A booster basket assembly is also provided.

19 Claims, 9 Drawing Sheets

U.S. PATENT DOCUMENTS

| | | | | | |
|---|---|---|---|---|---|
| 4,046,076 | A | | 9/1977 | Hampton | |
| 4,090,450 | A | * | 5/1978 | Nygards | 102/254 |
| 4,240,351 | A | * | 12/1980 | San Miguel | 102/262 |
| 4,278,026 | A | | 7/1981 | Hibbs et al. | |
| 4,337,702 | A | | 7/1982 | Betts | |
| 4,380,197 | A | * | 4/1983 | Eaton | 102/228 |
| 4,660,472 | A | | 4/1987 | Stevens | |
| 4,694,751 | A | | 9/1987 | Moosmann | |
| 4,738,100 | A | | 4/1988 | Koorey | |
| 4,751,881 | A | | 6/1988 | Fauconnier et al. | |
| 5,007,236 | A | | 4/1991 | Myers et al. | |
| 5,069,130 | A | | 12/1991 | Buckley et al. | |
| 5,113,763 | A | | 5/1992 | Schoeyer et al. | |
| 5,279,226 | A | | 1/1994 | Ritchie et al. | |
| 5,335,600 | A | | 8/1994 | Horr et al. | |
| 5,390,487 | A | | 2/1995 | Moore et al. | |
| 6,711,890 | B2 | | 3/2004 | McGuire | |
| 6,992,877 | B2 | | 1/2006 | DeVries | |
| 7,258,068 | B2 | * | 8/2007 | Worthington | 102/256 |
| 7,464,648 | B2 | * | 12/2008 | Teowee et al. | 102/254 |
| 7,784,404 | B2 | * | 8/2010 | DeVries et al. | 102/221 |

OTHER PUBLICATIONS

Dept. of Defense Test Method Standard, "Fuze and Fuze Components, Environmental and Performance Tests for," MIL-STD-331C, Jan. 5, 2005 (superseding MIL-STD-331B of Dec. 1, 1989).

THIOKOL paper dated Jul. 30, 1999.

* cited by examiner

DUAL FAULT SAFE AND ARM DEVICE, ADAPTIVE STRUCTURES THEREWITH AND SAFETY AND RELIABILITY FEATURES THEREFOR

CROSS-REFERENCE TO RELATED APPLICATION

This application is a divisional of U.S. patent application Ser. No. 11/933,883, filed Nov. 1, 2007, now U.S. Pat. No. 7,784,404, issued Aug. 31, 2010, the disclosure of which is hereby incorporated herein by this reference in its entirety.

FIELD OF THE INVENTION

The invention is related generally to safe and arm devices, adaptive structures therewith and reliability features therefor. More particularly, embodiments of the invention are related to electromechanical safe and arm devices, such as a booster assembly, having dual fault tolerant safety and reliability features that may be used individually or as part of a system requiring maximum degrees of safety and reliability desirable for connection to solid propellant or igniter engines.

BACKGROUND OF RELATED ART

Reusable solid rocket motors (RSRM) used for launching and controlling spacecraft for human and non-human rated flight utilize safe and arm devices to control unwanted ignition of the rocket motor. These conventional safe and arm devices include a mechanical barrier, an initiator and a so-called "booster charge" or ignitable composition. The mechanical barrier may be positioned between a so-called "safe" position and a so-called "arm and fire" position. The safe position prevents an inadvertent so-called "firing" or detonation action of the initiator from being propagated along a so-called "fire path" to the booster charge. The arm and fire position allows firing of the initiator upon receipt of a proper mechanical or electrical impulse to be propagated along the fire path to ignite the booster charge. The safe and arm device is conventionally flanged mounted into an end of the RSRM and sealed thereto with a flange gasket made from leather or other suitable material for flange gaskets. In other applications, the safe and arm device may also be directly mounted into a housing of an igniter, which is also mounted in the RSRM.

A conventional safe and arm device 900 as shown in FIG. 9 includes an actuation and monitoring assembly 902 coupled to a barrier base assembly 904 allowing for selective positioning of a mechanical barrier 906. The barrier base assembly 904 includes the mechanical barrier 906, two initiators 908, 928, electrical position switches 910 and a pellet basket 912. The actuation and monitoring assembly 902 includes an electromotive drive 914, electrical position switches 916, manual safing mechanism 918, and an in-line gear train 920 to rotationally position the mechanical barrier 906 of the barrier base assembly 904.

The barrier base assembly 904 also includes leak test ports 922 for testing or monitoring redundant shaft seals 924 located on a shaft of the mechanical barrier 906 and redundant initiator seals 926 located between each initiator 908 and 928 and the barrier base assembly 904. The seals 924, 926 help to prevent energy coming from a motor of the RSRM (not shown) from escaping through the barrier base assembly 904 during combustion, to contain energy within the barrier base assembly 904 in the event of inadvertent initiator firing and to protect the internal compartments of the barrier base assembly 904 from corrosion. A flange gasket 930, which is depicted in broken lines, provides a seal between the motor of the RSRM and the flange 931 of the safe and arm device 900. The flange gasket 930 also helps prevent energy from escaping from the motor of the RSRM during combustion. While the flange gasket 930 is highly reliable, it is desirable to monitor or verify the adequacy of the seal between the RSRM and the conventional safe and arm device 900.

In addition to being used with the motor of an RSRM, the safe and arm device 900 may be used with a jettison motor (not shown) of an aircraft or other vehicle in flight. Conventional safe and arm device 900 includes two initiators 908, 928, one of which provides single redundancy should one of the initiators fail to fire when receiving the proper mechanical or electrical impulse. Accordingly, it is also desirable to provide a safe and arm device 900 that provides further redundancy should both initiators 908, 928 fail to fire, especially when the safe and arm device 900 is used with jettison motors or other motors that necessitate increased reliability.

Further, the manual safing mechanism 918 of the actuation and monitoring assembly 902 allows a safing pin (not shown) to be installed into the manual safing mechanism 918 by rotating the mechanical barrier 906 to the safe position and then locking the safing pin into the manual safing mechanism 918. The safing pin physically prevents the mechanical barrier 906 from positioning (rotating) into the arm and fire position beyond, i.e., out of, the so-called "sure-safe" region. The sure-safe region also includes the safe position. The sure-safe region is determined by the required degrees of safety and reliability as may be defined in Naval Ordnance (NAVORD) report 2101 and the Bruceton testing procedure. Conventional wisdom with respect safety concerns and avoidance of unintentional firing by a conventional safe and arm devices, such as conventional safe and arm device 900, may require greater than five degrees of safety and reliability when the mechanical barrier 906 is positioned in the so-called "sure-safe" region. For the conventional safe and arm device 900, six degrees of safety and reliability is achieved when the mechanical barrier 906 is rotated at least 26.3 degrees away from the fire and arm position toward the safe position. In this respect, when the mechanical barrier 906 is positioned between 0 and 66 degrees, 66 and 74 degrees or 74 and 90 degrees, the safe and arm device 900 is respectively in the safe position, an unknown position or the fire and arm position. When installed properly, the safing pin ensures that the mechanical barrier 906 cannot be rotated out of the sure-safe region. However, because of tolerance between gears and mechanical engagement requirements of the manual safing mechanism 918, the mechanical barrier 906 may be rotated toward the fire and arm position approximately 30 degrees by the electromotive drive 914 of the actuation and monitoring assembly 902. While the manual safing mechanism 918 physically ensures that the mechanical barrier 906 is secured within the sure-safe region of the safe position thereby allowing the degrees of safety and reliability to be adequately maintained until the safing pin is removed, indication by sensor signal may be lost because the mechanical barrier 906 is rotated beyond the indication limits of the electrical position switches 910, 916 (conventionally set for indicating approximately 10 degrees of rotation from either the arm and fire position or the safe position). In this regard, while the safing pin is installed, the mechanical barrier 906 may be in the sure-safe region, but rotated beyond the indication capabilities of the electrical position switches 910, 916. Accordingly, it would also be of advantage to provide a safing pin and safing assembly 918 (with an accompanying gear arrangement) that limits rotation of the mechanical barrier 906 to within the rotational limits of the electrical position switches 910, 916 in order to provide positive indication (physical indication and electrical indication) of the safe position when the mechanical barrier 906 is within the sure-safe region while providing a so-called "lock" to prevent the mechanical barrier 906 from rotating into the arm and fire position even when commanded by the electromotive drive 914 of the actuation and monitoring assembly 902.

The ignitable composition of the so called "booster charge" of the safe and arm device 900 is contained between the pellet basket 912 and barrier base assembly 904. The ignitable composition may be a packet of boron potassium nitrate ($BKNO_3$) pellets, such as a VELOSTATE™ bag with $BKNO_3$ therein. The pellet basket 912 includes a cylindrical housing having two open ends and fastener ports for receiving retaining bolts 932 therethrough. The packet of $BKNO_3$ pellets is received into the cylindrical housing at one open end and a diffuser plate is coupled to the other open end. The open end of the pellet basket 912 is coupled to the barrier base assembly 904 with the bolts 932. The diffuser plate allows energy from the ignitable composition, when combusting, to be axially expelled from the pellet basket 912. It is necessary to use care in properly assembling the pellet basket 912 so as to avoid loss of ignitable material. Further, to ensure that the "fire-path" through the mechanical barrier 906 is correct when positioned in the arm and fire position, the pellet basket 912 must be adequately located, aligned and secured to the booster base assembly 904. Accordingly, it would be of additional advantage to provide a safe and arm device that includes a pellet basket that is modular in design and self-contained, enabling attachment of pellet baskets containing different amounts of the ignitable composition to the booster base assembly 904. Moreover, it is also desirable to provide a pellet basket that includes a self-locating feature for ensuring proper, i.e., determinate, alignment of the fire-path between the initiator 928, mechanical barrier 906, and the pellet basket 912. Furthermore, it is desirable to provide a pellet basket that includes a modular or standardized housing that enables coupling with a booster base while allowing different amounts of ignitable composition to be inserted therein. Still, it is desirable to provide a modular housing that self contains an ignitable composition for ready attachment to the booster base and the modular housing may be designed to further enhance directed diffusion of energy therefrom when the ignitable material is combusted.

BRIEF SUMMARY OF THE INVENTION

An embodiment of a safe and arm device includes the ability to verify and monitor the adequacy of a seal between the safe and arm device and its mounting upon a rocket motor, double redundancy (dual fault tolerant initiation) using at least three initiators in the safe and arm device, positive indication of a safe position within the limits of switch contacts when a safing pin is installed into a safing assembly, and a standardized unitary booster basket assembly allowing for a modular ignitable composition.

Embodiments of the safe and arm device includes a booster base assembly having a booster base housing and a barrier. The booster base housing includes an axis, a shaft port extending substantially in line with the axis, at least three initiator ports located about the axis, and a matching number of explosive transfer paths in respective communication with the at least three initiator ports. The barrier includes a matching number of like-spaced fire-train transfer ports and an axially aligned drive shaft. The drive shaft of the barrier is coupled within the shaft port of the booster base housing allowing the barrier to be rotationally positioned about the axis into at least one of a safe position and an arm and fire position and, in the latter position, allowing the fire-train transfer ports to be substantially aligned with a matching number of explosive transfer paths.

Embodiments of a safe and arm device include booster basket assemblies comprising structures including a modular interface structure for connection to the booster base assembly for containing and burning varying quantities of a combustible material without modification to the booster base assembly. The booster basket assemblies may be preloaded with the combustible material prior to connection to the booster base assembly.

The features of the safe and arm device will become apparent when viewed in light of the detailed description of the various embodiments of the safe and arm device when taken in conjunction with the attached drawings and appended claims.

DETAILED DESCRIPTION OF THE INVENTION

Figure 1:
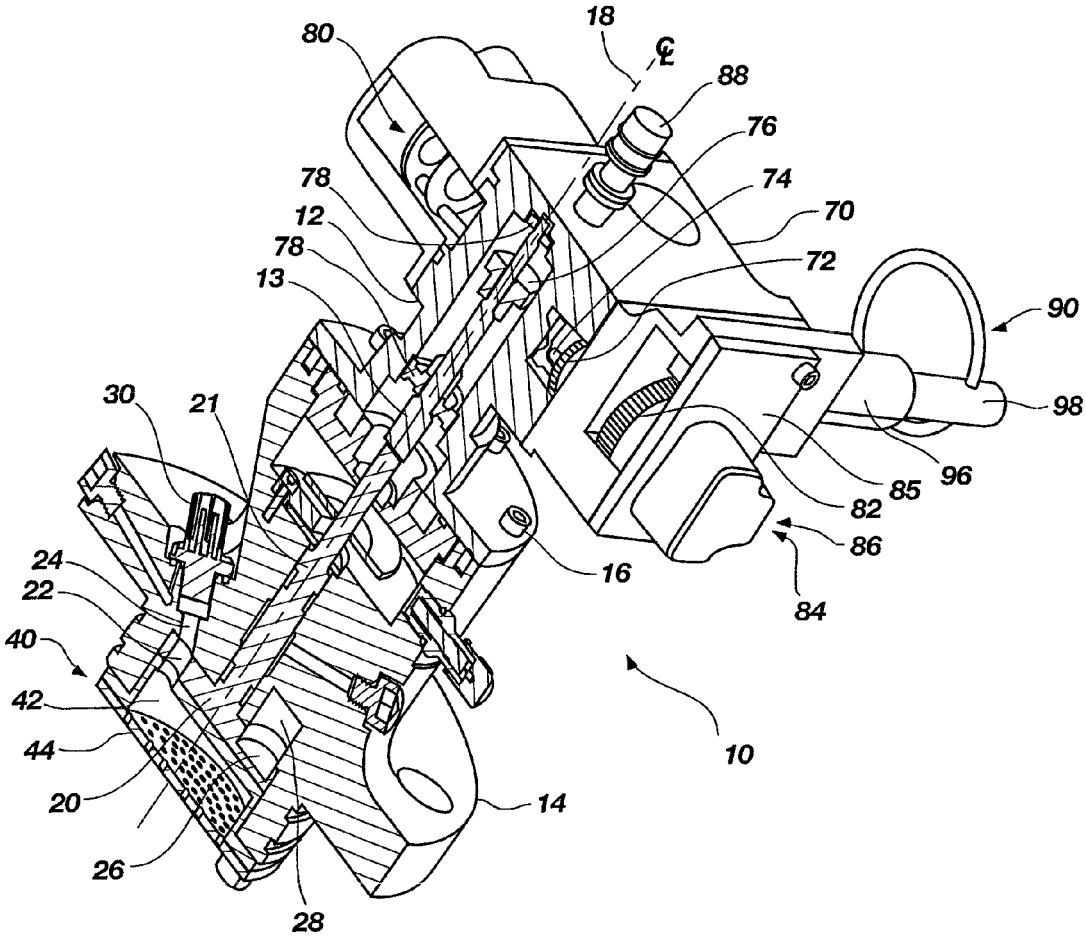
FIG. 1 is a partial cross-sectional, perspective view of a safe and arm device in accordance with an embodiment thereof.

Reference will now be made to the Figures, wherein like numerals refer to like features and elements throughout. It will be appreciated that these Figures are not necessarily drawn to scale.

One embodiment of the invention comprises a safe and arm device offering double redundancy in a firing and safety system particularly suited for applications of critical motor initiation, such as igniting a reusable solid rocket motor (RSRM) or providing for flight crew evacuation with a jettison motor abort or attitude control motors. The safe and arm device provides three independent initiators that may be fired concurrently to initiate burning the fuel in a motor. Where general requirements for conventional safe and arm devices have assumed the need for 90 degrees of physical rotation of a mechanical barrier between a safe position and an arm and fire position for a safe and arm device in order to meet the required degrees of safety and reliability as defined in Naval Ordnance (NAVORD) report 2101 and the Bruceton testing procedure limiting the rotation of the blocking device to 90-degree rotation and the number of initiators to two separated by 180 rotational degrees, embodiments of the safe and arm device of the invention achieve the required safety and reliability by providing a barrier requiring only about 60 degrees of physical rotation while also advantageously providing three initiators rotationally separated by 120 degrees. The three initiators advantageously increase the reliability for successfully "firing" the safe and arm device by providing dual backup, should one or two of the initiators fail to fire, with the second and third initiators. In this respect, the safe and arm device of the invention may tolerate two defective initiators without loss of firing capability thereby achieving a device having dual fault tolerance. The safe and arm design of embodiments of the invention also provides redundant monitoring of barrier position and provides a safing assembly to lock the barrier in the safe position in a manner monitorable by position switches. Further, the safe and arm device of embodiments of the invention comprises, in combination, a booster base assembly and an arm and motor assembly, which enables the arm and motor assembly to be reused after certification to save expense, while enabling design of the booster base assembly to handle the most severe expected operating conditions for a single use. Advantageously, by designing the booster base assembly for single use while providing a separate, reusable assembly for the arm and motor assembly, the total cost of manufacturing is significantly reduced, as is the overall device weight of the safe and arm device.

Embodiments of the safe and arm device of the invention offer improved mounting and sealing with associated rocket motors to contain motor gases under expected operational pressure. The safe and arm device utilizes cylindrical seals to provide sealing contact with a rocket motor that deviates from conventional rocket motor designs, such as a flange and gasket of the conventional RSRM. In this regard, a collar protrudes from the bottom of a flange of a booster base housing and includes redundant seal grooves on the outer cylindrical surface of the collar for receiving redundant O-ring seals therein to seal against an inside cylindrical surface of the rocket motor mounting. Use of the collar in the booster base housing enables configuration of a booster basket assembly that fits into an inner port of the collar and abuts against a barrier of the booster base assembly to enable standardized attachment of the booster basket assembly while providing unitary assembly thereof. In this regard, the booster basket assembly, together with a contained ignitable composition, provides a modular component that may include determinant assembly features for increasing the safety and reliability of assembling the booster basket assembly with the booster base housing. The booster basket assembly according to embodiments of the invention may be sized and shaped to accommodate various combustible compositions while providing a standardized attachment structure for engagement with the collar of the booster base assembly.

FIG. 1 shows a safe and arm device 10 in accordance with an embodiment of the invention. The safe and arm device 10 is suitable for use with rocket motors, such as an RSRM or a jettison motor (not shown). The safe and arm device 10 provides for dual initiation redundancy by exceeding minimum safety requirements while utilizing an electro-mechanical drive system to selectively position fire-train transfer ports 22 of a barrier 20 at a safe position or an arm and fire position. The barrier 20, as shown in FIG. 1, is positioned in the arm and fire position. In the arm and fire position, a fire-train transfer port 22 communicates with a corresponding explosive transfer path 24 to enable at least one of three pyrotechnic initiators 30 (only one initiator 30 depicted in FIG. 1 for clarity) to decisively propagate an energy wave (also known as "detonation action") to an ignitable composition (not shown for clarity) located within a cavity 42 of a booster basket assembly 40. In one embodiment of the invention it is recognized that the energy wave may include a flame and hot particles capable of initiating or igniting a pyrotechnic action or train of actions of an ignitable composition. The ignitable composition includes at least one pyrotechnic material, such as boron potassium nitrate ($BKNO_3$) pellets or $BKNO_3$ granules. The cavity 42 openly communicates through a perforated basket cover 44 of the booster basket assembly 40 with the associated rocket motor, enabling the ignitable composition to initiate burning of the fuel contained in the motor, such as the fuel in an igniter (not shown) of a motor. The safe and arm device 10 advantageously includes at least three initiators 30, providing at least dual redundancy for igniting the ignitable composition while ensuring a requisite level of safety by utilizing the barrier 20 to block the initiators 30 from igniting the ignitable composition at other, undesired times.

In the safe position (not shown), the barrier 20 is rotationally positioned to block propagation of an energy wave between the explosive transfer path 24 and the cavity 42 of the booster basket 40 should an inadvertent firing occur of one or more of the initiators 30. In this respect, the barrier 20 may include ullage cavities 26, providing additional expansion volume for receiving and containing the inadvertent energy wave propagated from the explosive transfer path 24, while preventing the energy wave from communicating with the cavity 42 of the booster basket 40. In this regard, while not shown in the figures, as the barrier 20 is rotationally positioned into the safe position, each of the ullage cavities 26 of the barrier 20 align with respective explosive transfer paths 24, while the fire-train transfer ports 22 in the barrier 20 are made non-communicative with the explosive transfer paths 24. Each ullage cavity 26 allows absorption of the energy wave if released from one or all of the initiators 30. Also, the safe and arm device 10 includes ullage chambers 28 in communication with the ullage cavities 26 when the barrier 20 is rotationally positioned into the safe position, which provides additional expansion volume to further absorb energy. The ullage cavities 26 and the ullage chambers 28 allow expanding gas, and other energy, to be contained during an inadvertent charging of the initiators 30 when the barrier 20 is not in the arm and fire position.

The safe and arm device 10 is configured to position the barrier 20 through a range of rotation from the arm and fire position to the safe position in order to provide a margin of safety sufficient to comply with or exceed requirements of National Aeronautics and Space Administration (NASA) human-rated flight systems. The safe and arm device 10 advantageously includes three initiators 30 providing dual redundancy as described above. Where the conventional safe and arm devices provide single redundant initiation by providing two initiators that require a barrier to be rotationally positioned through a range of 90 degrees motion in order to meet NASA requirements, the safe and arm device 10 advantageously provides dual fault initiation by providing at least three initiators 30 requiring the barrier 20 to be rotationally moved through only approximately 60 degrees of motion while exceeding NASA minimum degrees of safety and reliability requirements.

The safe and arm device 10 comprises an arm and motor assembly 12 and a booster base assembly 14. The arm and motor assembly 12 is coupled axially to the booster base assembly 14 by fasteners 16, allowing an output shaft 13 of arm and motor assembly 12 to be directly aligned with and coupled to a barrier drive shaft 21 of the barrier 20. Advantageously, space is conserved and optimized by having the safe and arm device 10 comprised of two assemblies 12 and 14, where the two assemblies 12 and 14 allow alignment of a drive train 220 (FIG. 10) directly or at a 90-degree mounting.

Figure 10:
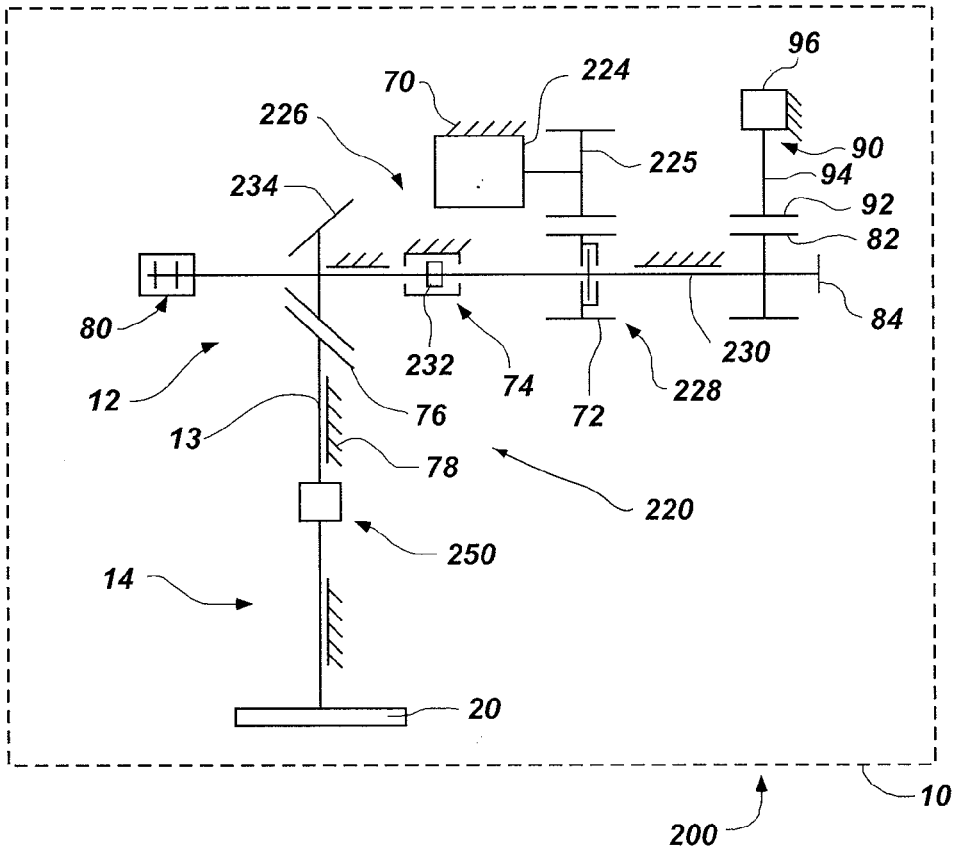
FIG. 10 is a schematic diagram illustrating a drive train of the safe and arm device of FIG. 1.

Before describing the booster base assembly 14, the arm and motor assembly 12 is described with continued reference to FIG. 1 (reference may also be made to FIG. 10 showing a schematic diagram 200 illustrating the drive train 220 of the safe and arm device 10 shown in FIG. 1).

The arm and motor assembly 12 provides an electro-mechanical drive system (i.e., drive train 220) for rotationally positioning the barrier 20 about the axis 18 as described above. The drive train 220 includes a conventional gear motor 224 to drive a conventional gear and transmission system 226 that applies torque to the output shaft 13 and through barrier drive shaft 21 to rotationally move the barrier 20 from the safe position to the arm and fire position as shown in FIG. 1. The gear motor 224 may also be used to drive the output shaft 13 in a reverse direction to position the barrier 20 into the safe position. The gear motor 224 is coupled to the inside of the arm and motor housing 70. The gear motor 224 rotates a spur gear 225 which engages another gear 72 that is rotationally coupled to a clutch assembly 228. The clutch assembly 228 rotationally drives an intermediate shaft 230, allowing the gear 72 to slip when the torque load exceeds a preload value. The torque preload is adjusted and fixed by the clutch assembly 228. The clutch assembly 228 coupled to the intermediate shaft 230 comprises an arbor 232 having stop arms 74 to limit the rotation of the intermediate shaft 230 to approximately 60 degrees. The stop arms 74 may, in some instances, limit the rotation of the intermediate shaft 230 to a greater or lesser extent from the 60 degrees indicated. Generally, the stop arms 74 will be limited to an angle approximately determined by dividing 360 degrees by two times the number of initiators 30 employed, and adjusted for any intervening gear reductions as will be discussed in further detail below.

The clutch assembly 228 is conventional in that it comprises a clutch plate, made from a material, such as a polymeric material or ceramic, compressively retained between the gear 72 and a pressure disk. The pressure disk supplies force (i.e., generates torque) upon the clutch plate from a Belleville spring, or washer, that is compressively loaded by a clamping collar that is threaded onto the arbor 232 of the intermediate shaft 230. The clamping collar may be rotated on and then secured to the arbor 232 to achieve an appropriate release torque in the clutch assembly 228. The clamping collar may be secured to the arbor 232 with a fastener once the desired torque level is set. The fastener may include, but is not limited to, a locking pin, set screw, jam nut, LOCKTITE®, and epoxy, for example, and without limitation. The intermediate shaft 230 is coupled to the arm and motor housing 70 by bearing assemblies (not shown).

The intermediate shaft 230 includes a gear 234, such as a helical gear, bevel gear and spiral bevel gear, for example, and without limitation, that rotationally engages a corresponding gear 76 on the output shaft 13 to provide a perpendicular oriented drive train 220 for improved utilization of space and utility for coupling with the booster base assembly 14. The output shaft 13 is rotationally supported and coupled to the arm and motor housing 70 by bearing assemblies 78 and axially secured therein by a fastener (not shown), such as a snap ring. The gear 76 transfers torque from the gear motor 224 through the intermediate shaft 230 to directly drive the output shaft 13. The output shaft 13 is oriented at 90 degrees to the intermediate shaft 230 with a gear ratio of 1:1. This gear ratio of 1:1 advantageously provides an equivalent rotational motion for the stop arms 74 as for the barrier 20. It is recognized that the gear ratio may be increased or decreased in order to change the fidelity of the switch mechanism. Optionally, the stop arms 74 and intermediate shaft 230 may have greater or lesser rotational travel than the 60 degrees provided, particularly when the gears 76 include a gear ratio compensating for rotationally positioning the barrier 20 between the safe position and the arm and fire position. The rotational motion allowed for the stop arms 74 and intermediate shaft 230 may also be affected by the rotational spacing between all initiators 30 provided upon the booster base assembly 14.

The intermediate shaft 230 also rotates switch or rotor contacts (not shown) of a double-stacked switch 80 that is coupled to the arm and motor housing 70. The double-stacked switch 80 provides electrical sensing of the position of the barrier 20, particularly when either in the safe position or the arm and fire position. One of the rotor contacts provides contact closure when the intermediate shaft 230 has rotated the barrier 20 approximately between 0 and 10 degrees from the safe position, and provides an open (i.e., no contact) closure when the intermediate shaft 230 has rotated the barrier 20 beyond 10 degrees from the safe position. The other rotor contact provides contact closure when the intermediate shaft 230 has rotated the barrier 20 to within approximately 10 degrees (substantially between 50 to 60 degrees rotation from the safe position) of the arm and fire position. Optionally, the rotor contacts may be configured for contact closures or opens over a greater or lesser extent than the 10-degree ranges indicated herein. The double-stacked switch 80 may also provide an electrical current path from a command control system (not shown) to power the gear motor 224 when positioning the barrier 20 between the safe position and the arm and fire position. Desirably, under normal operational conditions, the electrical continuity may be interrupted to the gear motor 224 when the barrier 20 is within 3-6 degrees of the desired rotational position to prevent a "stall" condition in the gear motor 224 or to prevent unnecessary slipping of the clutch assembly 228. However, the arm and motor assembly 12 may drive the gear motor 224 to the maximum rotational extent in either direction by allowing the clutch assembly 228 to slip when the stop arms 74 engage end stops (not shown) within the arm and motor housing 70. It is recognized that other switches or position indicators may be used in arrangements different from the double-stacked switch 80 as illustrated, and may further include a single switch or multiple switches. It is also recognized that the double-stacked switch 80 may include additional functions or monitoring positions utilizable to advantage in or to resolve rotation angle or control motor speed, such as with an encoder.

Further, a locking gear 82 and a visual position indicator 84 are coupled to the intermediate shaft 230. The visual position indicator 84 is mounted inside of a cover 85 coupled to the arm and motor housing 70. The cover 85 includes a lens 86, such as a mineral glass window, to allow personnel working on or near the safe and arm device 10 to ascertain by direct observation whether the safe and arm device 10 is in the safe position or in the arm and fire position. Typically, the visual position indicator 84 includes a surface (not shown) that rotationally transitions directly with the intermediate shaft 230 to provide a visual indicia of position. The visual indicia may include a red color and or the letter "A" to indicate the arm and fire position, and a green color and/or the letter "S" to indicate the safe position.

Figure 1A:
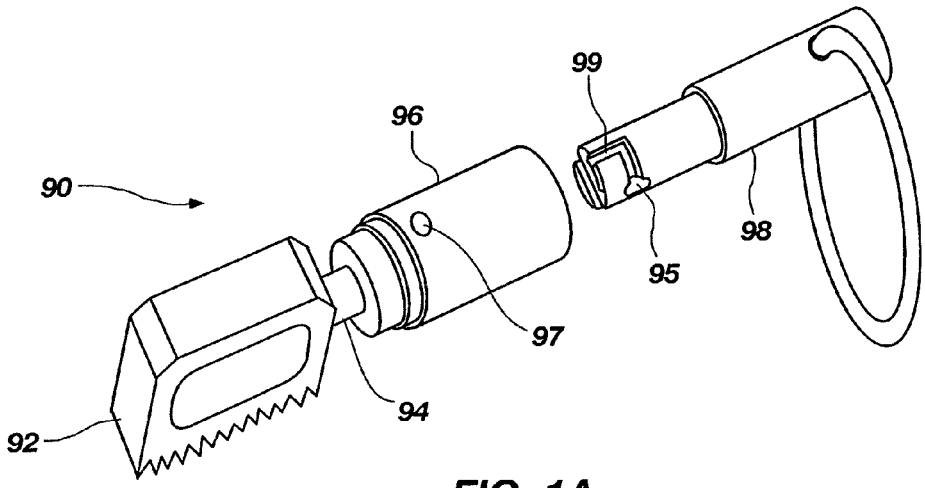
FIG. 1A is an exploded perspective view of a safing pin assembly of the safe and arm device of FIG. 1.

The locking gear 82 actuates a safing pin assembly 90. Reference may also be made to FIG. 1A showing the safing pin assembly 90. The locking gear 82 engages the teeth of a rack gear 92 to drive rack shaft 94, coupled thereto, axially into or out of safe pin adapter housing 96 along its axial length. The safe pin adapter housing 96 is coupled to the arm and motor housing 70 and includes a pin 97 (i.e., locking feature) extending therein.

A safing pin 98 may be inserted into or removed from the safe pin adapter housing 96 on the opposite side thereof from the rack shaft 94 when the locking gear 82 is rotationally positioned in the direction of the safe position. The safing pin 98 includes an "L" shaped slot 99 that engages the pin 97 of the safe pin adapter housing 96 when removing and inserting the safing pin 98 into the safe pin adapter housing 96. The slot 99 allows the safing pin 98 to be rotated approximately a quarter turn at the base of the "L" when fully inserted into the safe pin adapter housing 96 and engaged against a biasing spring (not shown) to bring the pin 97 longitudinally into retaining contact with a retention slot 95 of the safing pin 98 at the end of retention slot 95. The biasing spring is coupled within the safe pin adapter housing 96 to provide a retention force against the safing pin 98. When the safing pin 98 is installed, engagement between the retention slot 95 and the pin 97 prevents removal of the safing pin 98 from the safe pin adapter housing 96 when an arm and fire position is commanded to the gear motor 224. The safing pin 98 thus prevents the locking gear 82, by way of the rack gear 92, from rotating the intermediate shaft 230 and moving the barrier 20 out of the safe position. Also, the biasing spring supplies a retention force upon the safing pin 98 in order to hold the pin 97 in contact with the retention slot 95, which help prevents the safing pin 98 from being removed accidentally from the safe pin adapter housing 96. The safing pin 98 may only be removed when a safe signal is applied to the gear motor 224 or when the barrier 20 is in the safe position. The safing pin 98 cannot be removed from the safe pin adapter housing 96 when an arm signal is commanded to the gear motor 224, which supplies torque to the rack gear 92, causing force to be applied to the rack shaft 94 that forces the retention slot 95 against the pin 97.

An arm signal command may be given to the gear motor 224 after insertion of the safing pin 98 into the safe pin adapter housing 96 causing the rack gear 92 to rotate and provide additional locking force upon the pin 97 by way of the retention slot 95, which helps to prevent the intentional or unintentional removal of the safing pin 98. In supplying the arm signal command, the rack gear 92 supplies the necessary locking force while only allowing the barrier drive shaft 21 to be rotated about 4 degrees within the safe position in order to maintain the barrier 20 in a safe position that is well within NASA minimum degrees of safety and reliability requirements. As described above, conventional safing pins and safing pin assemblies require the shaft of a barrier to be rotated up to 30 degrees to lock the safing pin into the housing of the safing pin assembly, a degree of rotation which provides no indication of barrier position from the switch or switch stack assemblies employed in the safe and arm device because the switch stack assemblies are rotated beyond the contact closure limits when in the safe position and are yet within the contact closure limits of the arm and fire position. Advantageously, the rack gear 92 may be sized to provide necessary locking force upon the safing pin 98 by allowing the barrier 20 to be rotated to a greater or lesser extent than the 4 degrees indicated. However, it is desirable to size the rack gear 92 to prevent rotation of the barrier 20 beyond about 10 degrees of the safe position in order to receive positive indication that the contacts of the double-stacked switch 80 are closed, allowing independent, remote verification that the barrier 20 is still within the safe position.

The arm and motor assembly 12 also includes between its various components O-ring seals (not shown) to help provide protection from atmospheric corrosion during storage and operation of the safe and arm device 10. To further protect the arm and motor assembly 12 from internal corrosion, a dill valve 88 is provided in the arm and motor housing 70. The dill valve 88 may be used to evacuate and pressurize internal spaces of the arm and motor housing 70 with a gas such as nitrogen gas, which is inert and helps to prevent atmospheric and galvanic corrosion.

Figure 11:
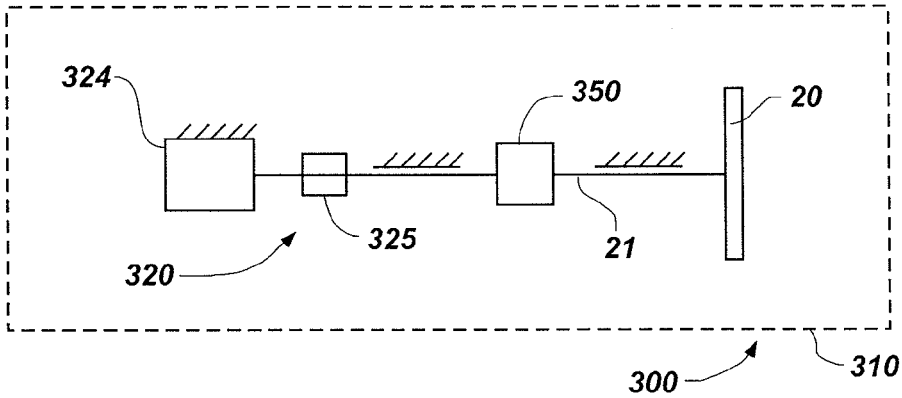
FIG. 11 is a schematic diagram illustrating another drive train of a safe and arm device in accordance with embodiments of the invention.

Referring to FIG. 11, a schematic diagram 300 illustrates a simplified drive train 320 for use with a safe and arm device 310. The drive train 320 provides a gear motor 324 having a gear box 325 for directly driving a barrier drive shaft 21 to position a barrier 20 into position as previously described herein. The drive train 320 may optionally include any feature, such as a clutch assembly, position indication switches, or stop arms, for example, and without limitation, as herein described, the feature being directly or indirectly coupled to the barrier drive shaft 21 as would be recognized by a person having skill in the art. Also, the barrier drive shaft 21 may include a coupling 350 for facilitating assembly of the booster base assembly 14 and the arm and motor assembly 12 (FIG. 1) of the safe and arm device 310. The motor 324 may comprise a stepping type motor or a motor having an integral position sensor, such as an encoder or potentiometer, therein to indicate the position of the drive shaft of the motor.

Figure 8:
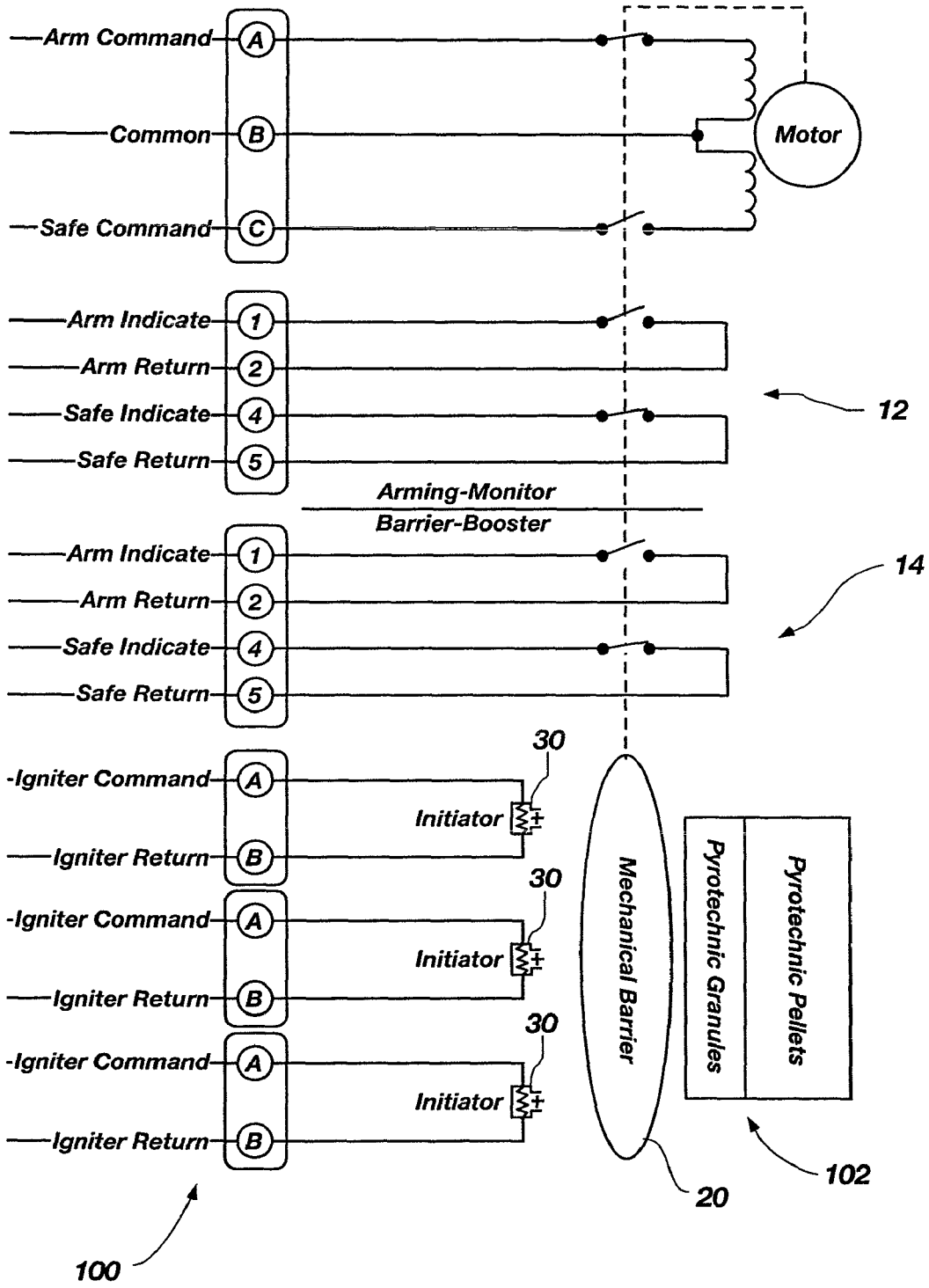
FIG. 8 is a schematic diagram illustrating electro-mechanical circuitry of the safe and arm device of FIG. 1.

Referring to FIG. 8, shown is a schematic diagram 100 illustrating the electro-mechanical circuitry of the safe and arm device 10 as described herein. In order to achieve at least dual redundancy, at least three initiators 30 are required to be in communication with an ignitable composition 102 when the barrier 20 is positioned in an arm and fire position. The schematic diagram 100 illustrates a situation when the barrier 20 is in the safe position and held there by the safing pin 98 (FIGS. 1 and 1A) even though an arm signal is being commanded to the gear motor 224 (FIG. 10).

Figure 2:
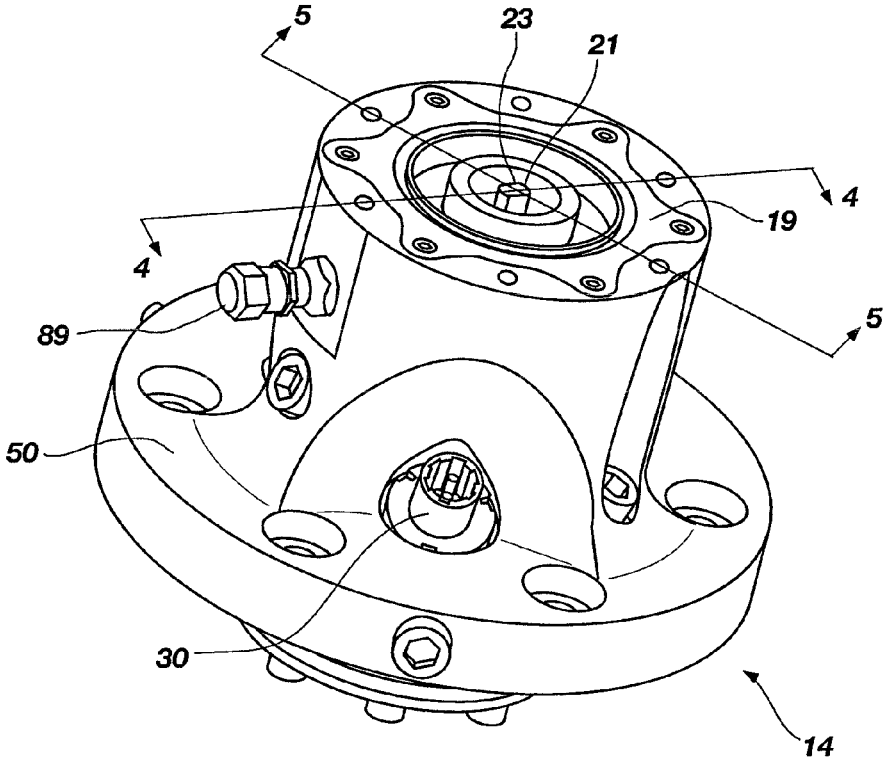
FIG. 2 is a perspective view of a booster base assembly of the safe and arm device of FIG. 1.
Figure 3:
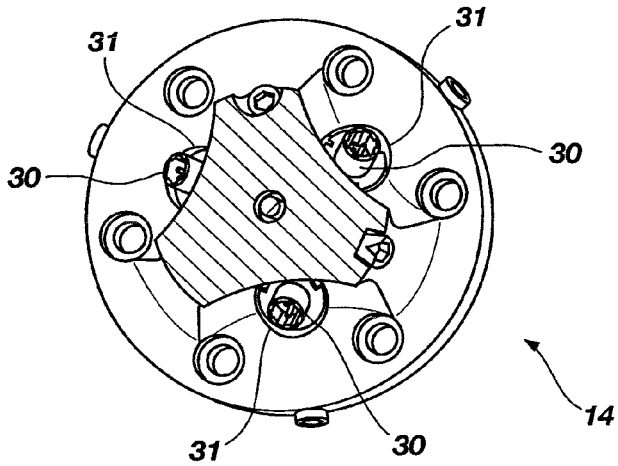
FIG. 3 is a partial cross-sectional view of the booster base assembly of FIG. 2 transverse to the longitudinal axis of the assembly.
Figure 4:
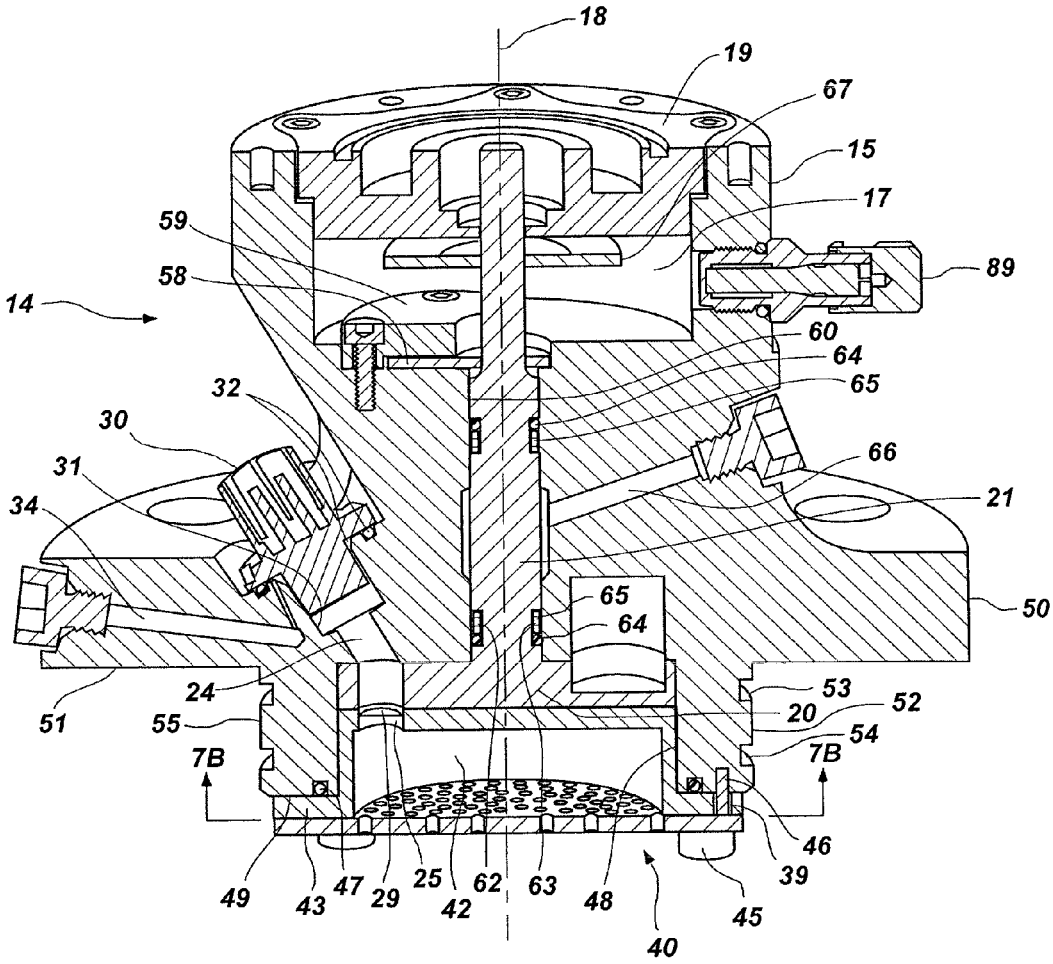
FIG. 4 is a cross-sectional view of the booster base assembly of FIG. 2, taken across section line 4-4.
Figure 5:
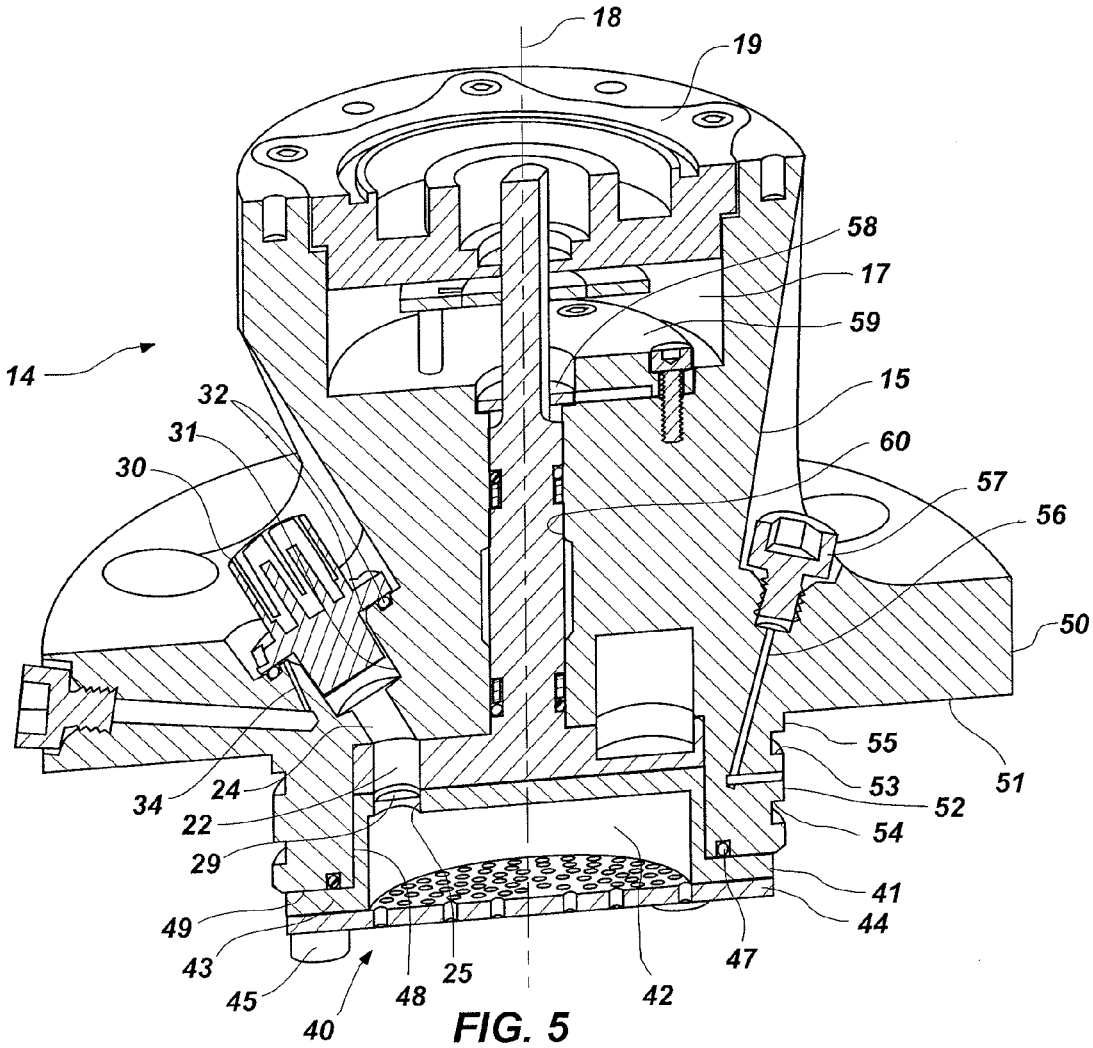
FIG. 5 shows a cross-sectional view of the booster base assembly of FIG. 2, taken across section line 5-5.

Further to the description given above, referring to FIG. 2, shown is the booster base assembly 14 of the safe and arm device 10 of FIG. 1. Reference is also to be made to FIGS. 3 through 5. The barrier drive shaft 21 for barrier 20 of the booster base assembly 14 includes a tongue 23 for coupling to a groove feature (not shown) on the output shaft 13 of the arm and motor assembly 12 allowing torque to be transferred from the output shaft 13 directly to the barrier drive shaft 21 for positioning the barrier 20 as generally indicated by reference numeral 250 as shown in FIG. 10. While coupling the safe and arm device 10 includes the tongue 23 and the groove feature as shown, other conventional couplings may be utilized to couple the output shaft 13 to the barrier drive shaft 21. The booster base assembly 14 includes a booster base housing 15 and a mounting flange 50 extending therefrom. The mounting flange 50 may be secured to a housing (not shown) of an igniter or rocket motor (both not shown) by threaded fasteners (not shown). The threaded fasteners, the mounting flange 50 and the booster base housing 15 are designed appropriately to withstand maximum expected operating pressures generated by combusting the fuel of the rocket motor. A collar 52, extending circumferentially about the axis 18 of the booster base housing 15, extends radially from a bottom 51 of the mounting flange 50 and includes two grooves 53, 54 in its outer wall 55. The outer wall 55 is substantially cylindrical in shape. The two grooves 53, 54 may each receive a seal (not shown), such as an O-ring, to seal the collar 52 within a substantially cylindrical shaped port of the housing of the igniter or rocket motor in order to eliminate or at least minimize pressure escape when combusting the fuel thereof. The seals may be dimensioned to maintain them under compression when the booster base assembly 14 is mounted in the housing of the rocket motor. Further, as shown in FIG. 5, a leak check port 56 extends from the booster base housing 15 to the outer wall 55 of the collar 52 and between grooves 53 and 54. The leak check port 56 is plugged by a plug 57 coupled, such as by threads, to the booster base housing 15. The plug 57 may include a plug seal (not shown) to provide a seal with the booster base housing 15. The leak check port 56 allows the integrity of seals of the collar grooves 53, 54 to be verified and monitored after installation between the collar 52 and the housing of the igniter or rocket motor.

As shown in FIG. 3, the booster base assembly 14 includes three initiators 30. Each of the initiators 30 is coupled to one of the three threaded initiator ports 31 that are in communication with the explosive transfer path 24 (FIG. 1). The initiator ports 31 are radially positioned in the booster base housing 15 and located substantially similarly about the axis 18 at 120-degree increments. The use of three initiators 30 advantageously provides double redundancy should one or two of the initiators 30 fail to fire when commanded. The three initiator ports 31 provide additional versatility by allowing a booster base assembly 14 to be standardized for applications requiring double redundancy or single redundancy. When only single redundancy is required, any one of the three initiator ports 31 may be plugged. It is to be recognized that additional initiator ports 31 greater than the three illustrated may optionally be included; for example, four initiator ports at 90-degree intervals may be employed. Also, while the initiator ports 31 are equally spaced at 120 degrees about the axis 18 to maintain acceptable margins of safety and reliability on the barrier 20 when rotated through a range of 60 degrees, the initiator ports 31 may be positioned to a greater or lesser angular spacing so long as margins of safety meet or exceed NASA requirements.

Initiators 30 may comprise a NASA standard initiator (NSI) or any other suitable initiator. An example of an initiator suitable for use with the safe and arm device 10 is disclosed in U.S. Pat. No. 6,992,877, titled "Electronic Switching System for a Detonation Device," the entire disclosure of which is incorporated herein by reference.

Referring back to FIGS. 4 and 5, redundant seals 32, such as O-ring seals, are provided between each initiator 30 and its initiator port 31 to help minimize or prevent pressure and hot gases coming from combusting fuel in the rocket motor from escaping through the booster base assembly 14. As in the case of collar 52, a leak check port 34 is provided for testing and verifying the integrity of the seals 32.

As mentioned above, the barrier 20 is rotationally positioned about the axis 18 by the barrier drive shaft 21. The barrier drive shaft 21 and barrier 20 as illustrated are made from a unitary piece of material, but may also be made from multiple pieces of material that are coupled together. The barrier drive shaft 21 is closely slidably contained by the bearing surface of the shaft port 60 in the booster base housing 15. The shaft port 60 is centered substantially symmetrical about the axis 18.

The barrier drive shaft 21 may include grooves 62 and 63 that each include a seal 64, such as an O-ring, and a backing ring 65, such as a high-temperature V-rings disposed between the wall of the shaft port 60 and barrier drive shaft 21 to help minimize or prevent pressurized, combusting fuel in the rocket motor from escaping through the booster base assembly 14. As in the case of collar 52, a leak check port 66 is provided between grooves 62 and 63 for testing and verifying the integrity of the seals 64.

A rotor stop arm 58 directly coupled to the barrier drive shaft 21 limits the rotation of the barrier 20 to approximately 60 degrees by being physically limited to rotationally travel within a slotted channel within a cover 59 securely fastened to the booster base housing 15. However, the rotor stop arm 58 may limit rotation of the barrier 20 to a greater or lesser extent than the 60 degrees described in the case of other designs within the scope of the invention. In this respect, the rotor stop arm 58 is held in position with the cover 59 and restrains the limited motion of the barrier 20 about the axis 18 by limiting the extent of rotational travel by the rotor stop arm 58. The cover 59 is coupled to the booster base housing 15 by fasteners (unnumbered).

The barrier drive shaft 21 also rotates rotor contacts of a switch 67. The switch 67 is coupled to an inside cavity 17 of the booster base housing 15. The switch 67 provides electrical sensing of the position of the barrier 20, particularly when positioned in the safe position and the arm and fire position. The switch 67 may be a single switch or a double-stacked switch, but includes at least two rotor contacts. One of the rotor contacts provides a contact closure when the barrier drive shaft 21 has rotated the barrier 20 between 0 and 10 degrees from the safe position, and provides an open connection when the intermediate shaft 230 has rotated the barrier 20 beyond 10 degrees from the safe position. The other rotor contact provides a separate signal indicating contact closure when the barrier drive shaft 21 has rotated the barrier 20 to within 10 degrees (50 to 60 degrees rotation from the safe position) of the arm and fire position. Optionally, the rotor contacts may be configured to have contact closures or opens to a greater or lesser extent than the 10 degrees indicated herein. It is recognized that other switches or position indicators different from the switch 67 as illustrated may be used.

A cover 19 coupled to the booster base housing 15 contains the inside cavity 17 and allows a seal (not shown) to be maintained between the arm and motor housing 70 (FIG. 1) and the booster base housing 15 when the arm and motor assembly 12 (FIG. 1) is coupled to the booster base assembly 14, respectively. A dill valve 89 may also be coupled to the booster base housing 15 to allow the inside cavity 17 to be charged with a gas, such as nitrogen, to protect the internal components from corrosion during storage and operation of the safe and arm device 10.

Electrical ports (not shown) are provided in the arm and motor housing 70 and the booster base housing 15 for mounting electrical connectors (not shown) that are respectively electrically coupled to the contacts (not shown) of the switches 67 and 80, and supply power to the gear motor.

Figure 9:
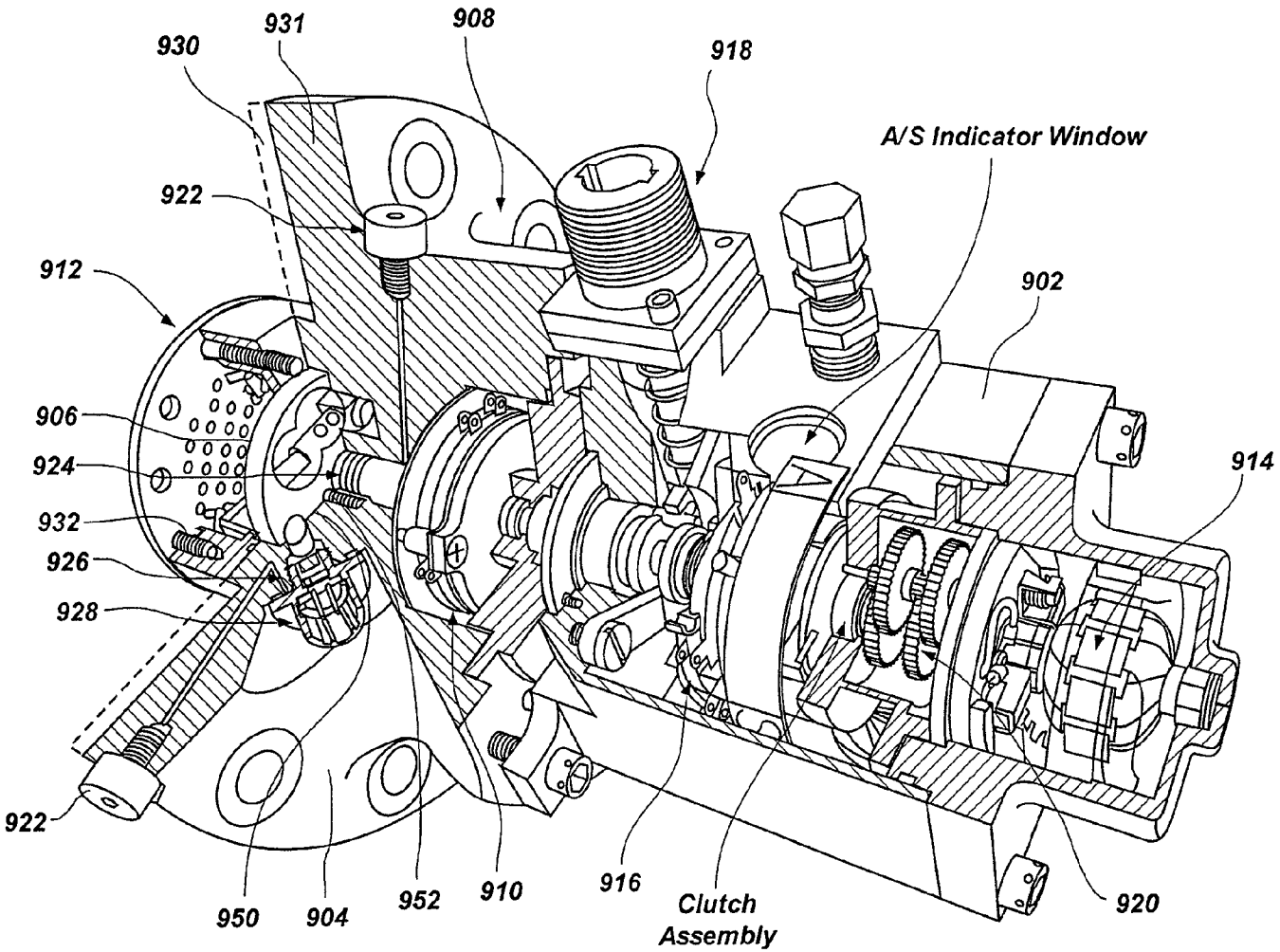
FIG. 9 (PRIOR ART)
FIG. 9 shows a conventional safe and arm device.

To facilitate positioning of the barrier 20 as described above, the barrier 20 may include a series of detents (see reference numeral 950 as shown in FIG. 9) spaced 60 degrees apart so as to correspond with the locations of fire-train transfer ports 22 therein. One of the detents 950 will engage a spring biased ball plunger (see reference numeral 952 as shown in FIG. 9) when the barrier 20 is located in either the safe position or the arm and fire position in order to help retain the barrier 20 in the desired position. The spring biased ball plunger 952 is coupled to the booster base housing 15.

While many of the components mentioned herein may be made from stainless steel, including other metallic materials for example, it is desirable to make the booster base housing 15, the booster basket assembly 40 and the arm and motor housing 70 out of an aluminum, such as 2024-T351 aluminum alloy, in order to decrease the weight. The material of all components mentioned herein may be made from materials that are generally suitable for safe and arm devices and, particularly, those materials that are generally known to a person having ordinary skill in the art.

Reference may now be made to FIGS. 4, 5, 6A, 7A and 7B with respect to the booster basket assembly 40. The booster basket assembly 40 includes a basket housing 41 having a flange 43 and a basket cover 44 coupled to the flange 43 with fasteners 45, such as hex-head bolts. The booster basket assembly 40, in service, contains an ignitable composition within its cavity 42 as described above. The cavity 42 is defined by the substantially cylindrical sidewall and substantially closed end of the basket housing 41. The booster basket assembly 40 is coupled to the collar 52 by inserting the basket housing 41 into a collar port 48 located in the booster base housing 15 and securing the flanges 43 of the basket housing 41 to a flange surface 49 of the collar 52.

Optionally, a seal 47 may be provided between the flange surface 49 of the collar 52 and the flange 43 of the basket housing 41 to help with containment of expanding gas should one of the initiators 30 be inadvertently ignited when the barrier 20 is not in the arm and fire position.

Further, an alignment feature 46, such as a pin, may optionally be provided that extends from the flange surface 49 of the collar 52. The alignment feature, or pin 46 engages a strategically placed alignment feature in the form of port 39 located in the basket housing 41 to ensure that explosive transfer path ports 25 within the basket housing 41 will be aligned with the fire-train transfer ports 22 of the barrier 20 when the latter is positioned in the arm and fire position.

Also, the explosive transfer path ports 25 may each optionally include a rupture disc 29 seal-welded therein. The rupture discs 29 are designed to burst, allowing an energy wave to be propagated through the explosive transfer path port 25 from the explosive transfer path 24 and fire-train transfer port 22, when the initiators 30 are fired and the barrier 20 is positioned in the arm and fire position. Otherwise, the rupture discs 29 are designed to help contain an inadvertent firing of the initiators 30 when the barrier 20 is not in the arm and fire position.

Figure 6A:
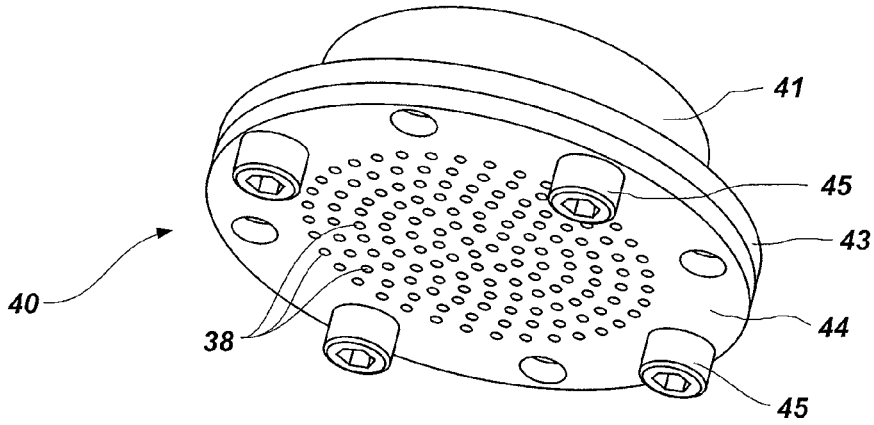
FIG. 6A is a perspective view of a booster basket assembly of the safe and arm device of FIG. 1.

The volume of cavity 42 of the booster basket assembly 40 may be adapted to contain the quantity of ignitable composition required for igniting a particular igniter or rocket motor. Particularly, the basket cover 44 may be designed or adapted for use with various sized igniters or rocket motors and may also be configured to help direct the burn of the ignitable composition. As shown in FIG. 6A, the basket cover 44 is shaped as a plate and includes perforations, or ports 38 that allow the ignitable composition to be conveyed to the fuel of an igniter or rocket engine when combusted.

Optionally, a polymeric film (not shown) may be attached to the inner or outer side of the basket cover 44 to provide an environmental seal over the ports 38. The polymeric film may also be removably attached in order to facilitate selective removal before use of the booster basket assembly 40 with a booster base; or may be made from a pressure sensitive material that includes a frangible or friable quality suitable during use with a booster base. The polymeric film may include a material that dissipates static energy.

Figure 6B:
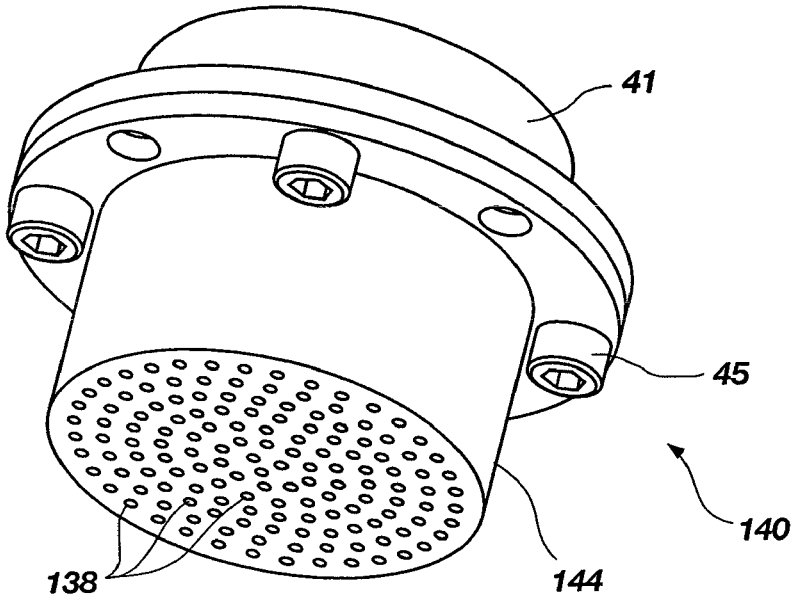
FIG. 6B is a perspective view of a booster basket assembly in accordance with another embodiment thereof.
Figure 6C:
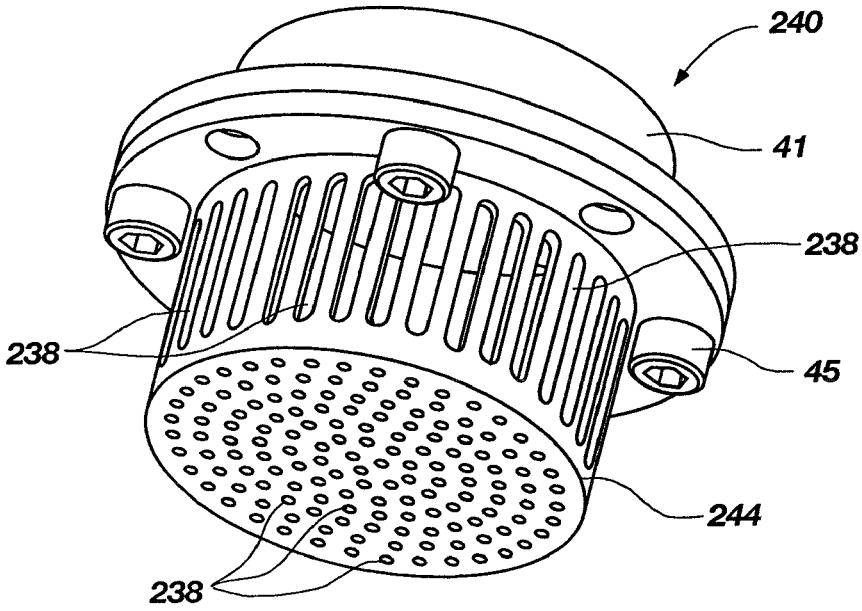
FIG. 6C is a perspective view of a booster basket assembly in accordance with yet another embodiment of the invention.
Figure 7A:
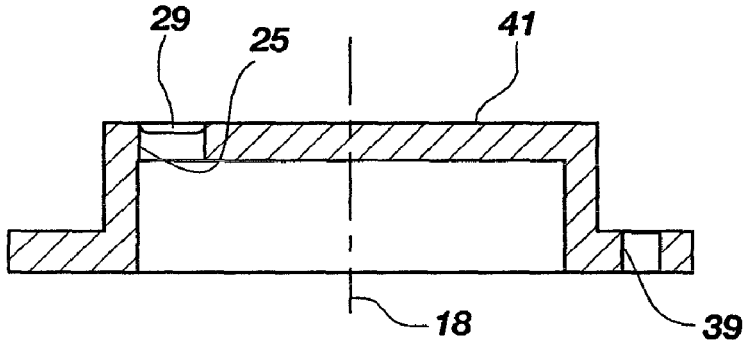
FIG. 7A is a side cross-sectional view of a housing of the booster basket assembly as illustrated in FIG. 6A.
Figure 7B:
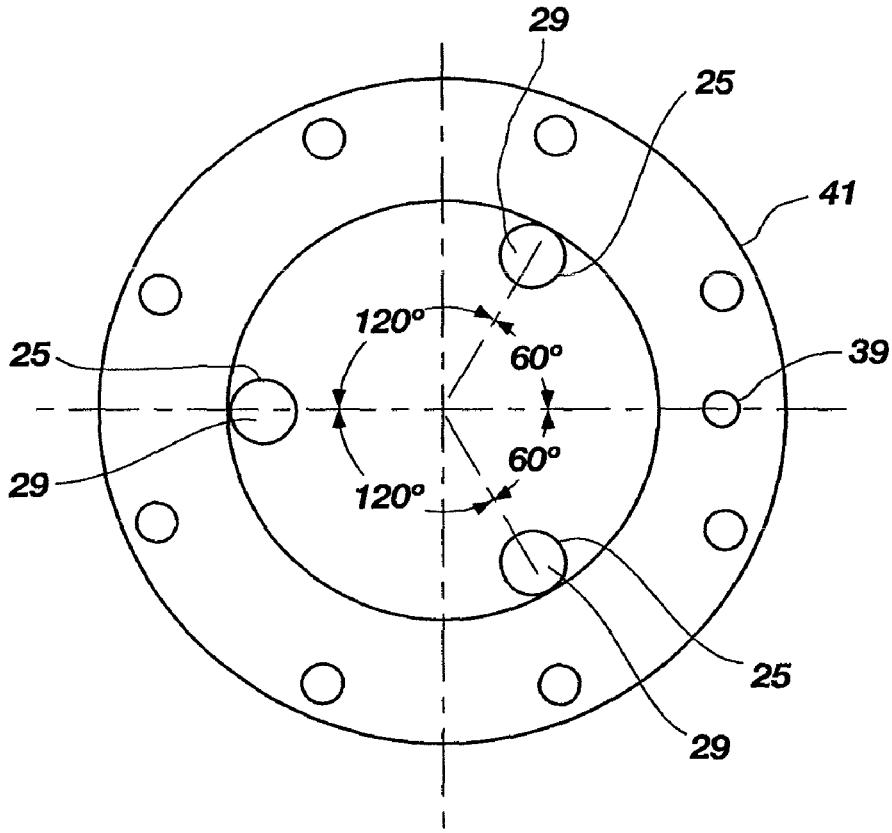
FIG. 7B is an end view of the housing of FIG. 7A.

Optionally, the basket cover 44 may have any other suitable shape than the plate shape as illustrated in FIG. 6A. For example, a basket cover 144 is shown in the booster basket assembly 140 of FIG. 6B. The basket cover 144 is "hat" shaped, providing an increased interior volume for cavity 42 (FIG. 1) and includes ports 138 extending axially therefrom at its bottom. As another example, a basket cover 244 is shown in the booster basket assembly 240 of FIG. 6C. The basket cover 244 is again hat shaped but has ports 238 extending both axially and radially therefrom. The ports 38, 138 and 238 of basket covers 44, 144 and 244, respectively, may have any shape, size and contour suitable for conveying the ignitable composition to the igniter or rocket motor as it is combusting.

Advantageously, the booster basket assemblies 40, 140, 240 may be pre-assembled and ready for assembly into the collar 52. Pre-assembly of the booster basket assemblies 40, 140, 240 is accomplished by containing an ignitable composition within the cavity 42 (FIG. 1) created between the basket cover 44, 144, 244 and the basket housing 41 and then securing the basket cover 44, 144, 244 to the basket housing 41, respectively, with fasteners or bolts 45, such as with hex-headed bolts. As is depicted in each of FIGS. 6A through 6C, additional apertures are provided circumferentially between bolts 45 to secure booster basket assemblies 40, 140 and 240 to a booster base assembly 14.

Advantages provided by embodiments of this invention are: the ability to verify and monitor the adequacy of a seal between the safe and arm device and its mounting upon a rocket motor; double redundancy (dual fault tolerant initiation) by including at least three initiators in the safe and arm device; positive indication of a safe position within the limits of switch contacts when a safing pin is installed in to a safing assembly; and standardized unitary booster basket assembly allowing for modular and robust containment of an ignitable composition for ready installation with the safe and arm device. Other advantages provided by embodiments of this invention are provided herein.

Generally in embodiments of the invention, the safe and arm device provides for increased motor maximum expected operating pressure (MEOP), particularly, for use with an RSRM, because the booster base assembly 14 may be designed for man-rated single use while preserving the arm and motor assembly 12 for subsequent reuse after refurbishment and certification. By providing a device having the booster base assembly designed with increased MEOP that is man-rated and for single use, the safe and arm device is resultantly of lighter weight than conventional devices designed for the same criterion and for multiple reuses.

While particular embodiments of the invention have been shown and described, numerous variations and alternative embodiments will occur to those skilled in the art. Accordingly, it is intended that the invention be limited only in terms of the language of the appended claims and their legal equivalents.

What is claimed is:

1. A booster base assembly, comprising:

a booster base housing configured to couple with, and provide a booster charge to, a rocket motor, the booster base housing comprising:

a shaft port extending through at least a portion of the booster base housing;

at least one explosive transfer path extending through at least another portion of the booster base housing;

at least one initiator port in communication with the at least one explosive transfer path; and a collar axially extending from a bottom portion of the booster base housing, the collar comprising a collar port defining a collar cavity within the collar;

a barrier comprising a shaft coupled within the shaft port of the booster base housing, the barrier further comprising at least one fire-train transfer port extending therethrough, wherein the shaft is configured to position the barrier in at least one of a safe position and an arm-and-fire position, wherein the at least one fire-train transfer port is at least substantially aligned with the at least one explosive transfer path of the booster base housing when the barrier is positioned in the arm-and-fire position; and a booster basket assembly detachably coupled with the collar, wherein at least a portion of the booster basket assembly extends into the collar cavity, wherein the booster basket assembly comprises:

a basket cavity defined by a substantially solid wall and a substantially closed end;

at least one explosive transfer path port through the substantially closed end, the at least one explosive transfer path port at least substantially aligned with the at least one explosive transfer path of the booster base housing when the at least one fire-train transfer port of the barrier is positioned in the arm-and-fire position, wherein the barrier is configured to block communication between the at least one explosive transfer path port and the at least one explosive transfer path of the booster base housing when the barrier is positioned in the safe position; and a cover fixedly coupled relative to the substantially solid wall of the booster basket assembly, the cover comprising a plurality of perforations configured to enable energy to be expelled from the basket housing cavity during combustion of a combustible material housed therein.

2. The booster base assembly of claim 1, wherein the at least one initiator port includes three initiator ports that are positioned at locations spaced approximately 120 degrees around an axis of the booster base housing.

3. The booster base assembly of claim 1, wherein the barrier further comprises at least one ullage cavity radially spaced apart from the at least one fire-train transfer port, the at least one ullage cavity at least substantially aligning with the at least one explosive transfer path of the booster base housing when the barrier is not positioned in the arm-and-fire position.

4. The booster base assembly of claim 1, wherein the booster base housing further comprises:

at least one ullage chamber; and at least one ullage cavity radially spaced apart from the at least one fire-train transfer port, wherein the at least one ullage chamber communicates with the at least one ullage cavity, wherein the at least one ullage cavity is configured to be at least substantially aligned with the at least one explosive transfer path of the booster base housing when the barrier is not positioned in the arm-and-fire position.

5. The booster base assembly of claim 1, further comprising an initiator coupled to the at least one initiator port, a first dual redundant initiator coupled to a second initiator port, and a second dual redundant initiator coupled to a third initiator port, wherein at least one of the initiator, the first dual redundant initiator, and the second dual redundant initiator is configured to initiate propagation of an energy wave through the at least one explosive transfer path of the booster base housing in response to receiving a firing signal.

6. The booster base assembly of claim 5, wherein the firing signal includes at least one of a mechanical and an electrical impulse signal.

7. The booster base assembly of claim 1, wherein the booster basket assembly further includes a flange portion extending laterally from an end of the substantially solid wall, the flange portion coupling with a flange surface of the booster base housing, and wherein the cover of the booster basket assembly is fixedly coupled with the flange portion of the booster basket assembly.

8. The booster base assembly of claim 7, further comprising an alignment feature extending through the flange portion of the booster basket assembly and the flange surface of the booster base housing, wherein the alignment feature is configured to at least substantially align the at least one explosive transfer path port of the booster basket assembly with the at least one explosive transfer path of the booster base housing.

9. The booster base assembly of claim 1, wherein the collar further includes at least two radially extending grooves in an outer wall thereof and a leak check port located between the at least two grooves.

10. The booster base assembly of claim 1, wherein the rocket motor is selected from the group consisting of a reusable solid rocket motor, a jettison motor, and an attitude control motor.

11. A safe and arm device, comprising:

a booster base assembly comprising:

a housing, having a collar axially extending from a bottom portion of the housing, the collar comprising a collar port defining a collar cavity within the collar;

a plurality of explosive transfer paths in the housing; and a barrier positionable within the housing in at least one of a safe position and an arm-and-fire position;

a plurality of initiators coupled to the housing of the booster base assembly, wherein each of the plurality of initiators is configured to communicate an initiating signal through one of the plurality of explosive transfer paths;

an arm and motor assembly including a motor and an output shaft rotationally coupled with the motor and the barrier of the booster base assembly, wherein the motor is configured to drive the output shaft in order to position the barrier in one of the safe position and the arm-and-fire position; and a booster basket assembly detachably coupled to the booster base assembly, wherein at least a portion of the booster basket assembly extends into the collar cavity, the booster basket assembly comprising:

a basket cavity defined by a substantially solid wall and a substantially closed end of the booster basket assembly;

a plurality of explosive transfer path ports coupled through the substantially closed end of the booster basket assembly, the plurality of explosive transfer path ports aligned to communicate with the plurality of explosive transfer paths of the booster base assembly when the barrier is positioned in the arm-and-fire position; and a cover fixedly coupled relative to the substantially solid wall and comprising a plurality of perforations configured to enable energy to be expelled from the basket cavity during combustion of a combustible material housed therein.

12. The safe and arm device of claim 11, further comprising:

a safing pin assembly coupled with the arm and motor assembly; and at least one position switch coupled to one of the booster base assembly and the arm and motor assembly, wherein:

the at least one position switch includes a contact closure when rotated through a degree of rotation within the safe position; and the safing pin assembly includes a safing pin configured to be removably installed therein when the barrier is in the safe position and is further configured to prevent the barrier from being rotated out of the safe position and beyond the degree of rotation for contact closure.

13. The safe and arm device of claim 12, wherein the degree of rotation for contact closure is less than ten degrees.

14. The safe and arm device of claim 13, wherein the degree of rotation for contact closure is about four degrees.

15. A safe and arm device, comprising:

a booster base assembly including a housing, and a barrier positionable within the housing in at least one of a safe position and an arm-and-fire position, wherein the housing includes a collar axially extending from a bottom portion of the housing, the collar comprising a collar port defining a collar cavity within the collar; and a modular and detachable booster basket assembly coupled to the collar of the booster base assembly, wherein at least a portion of the modular and detachable booster basket assembly extends into the collar cavity, and is configured to house an ignition composition, the modular and detachable booster basket assembly comprising:

a substantially closed end and a side wall defining a basket cavity; and a cover including a plurality of perforations opposite the substantially closed end, the cover being fixedly coupled to the side wall.

16. The safe and arm device of claim 11, wherein the plurality of initiators are controllably configured to fire independently.

17. The safe and arm device of claim 11, wherein the plurality of initiators are controllably configured to fire at least substantially concurrently.

18. An arm and motor assembly of a safe and arm device, the arm and motor assembly comprising:

a motor;

an intermediate shaft rotationally coupled to the motor;

an output shaft rotationally coupled with the intermediate shaft;

a barrier coupled with the output shaft, the barrier including a plurality of fire-train transfer ports configured to at least partially align with a plurality of explosive transfer paths of a booster base assembly when in an arm-and-fire position, wherein the motor is configured to rotationally position the barrier in one of a safe position and the arm-and-fire position;

a collar port extending into a collar of a bottom portion of the booster base assembly; and a modular booster basket assembly coupled to the collar of the booster base assembly, wherein at least a portion of the modular booster basket assembly extends into the collar port, the modular booster basket assembly configured to house a combustible material in a basket cavity therein, wherein the modular booster basket assembly includes a first end including a plurality of explosive transfer path ports that align with the plurality of explosive transfer paths of the booster base assembly, and a second end fixedly coupled to a side wall defining the basket cavity.

19. The arm and motor assembly of a safe and arm device of claim 18, further comprising a safing pin assembly coupled to the arm and motor assembly, and at least one position switch coupled to the arm and motor assembly, wherein the position switch includes a contact closure when rotated through a degree of rotation within the safe position, and wherein the safing pin assembly includes a safing pin removably installed therein when the barrier is in the safe position, and the safing pin, when installed, is configured to prevent the barrier from being rotated from the safe position and beyond the degree of rotation for contact closure when the arm and motor assembly is coupled to the booster base assembly.

* * * * *

UNITED STATES PATENT AND TRADEMARK OFFICE

CERTIFICATE OF CORRECTION

PATENT NO. : 8,141,490 B2
APPLICATION NO. : 12/842767
DATED : March 27, 2012
INVENTOR(S) : Derek R. DeVries, Brent D. Madsen and Scott R. Jamison It is certified that error appears in the above-identified patent and that said Letters Patent is hereby corrected as shown below:

In the claims:

CLAIM 19, COLUMN 18, LINE 28, change "position switch" to --at least one position switch--

Signed and Sealed this
Twenty-seventh Day of August, 2013

Teresa Stanek Rea
*Acting Director of the United States Patent and Trademark Office*